US012692868B2

(12) United States Patent
Rodrigues

(10) Patent No.: US 12,692,868 B2
(45) Date of Patent: Jul. 28, 2026

(54) MULTISTAGE CENTRIFUGAL PUMP

(71) Applicant: Sulzer Management AG, Winterthur (CH)

(72) Inventor: Arnaldo Rodrigues, Winterthur (CH)

(73) Assignee: Sulzer Management AG, Winterthur (CH)

( * ) Notice: Subject to any disclaimer, the term of this patent is extended or adjusted under 35 U.S.C. 154(b) by 0 days.

(21) Appl. No.: 17/097,068

(22) Filed: Nov. 13, 2020

(65) Prior Publication Data

US 2021/0156397 A1 May 27, 2021

(30) Foreign Application Priority Data

Nov. 27, 2019 (EP) ..... 19211906

(51) Int. Cl.
*F04D 29/42* (2006.01)
*F04D 1/06* (2006.01)
*F04D 29/44* (2006.01)

(52) U.S. Cl.
CPC ..... *F04D 1/06* (2013.01); *F04D 29/4293* (2013.01); *F04D 29/445* (2013.01)

(58) Field of Classification Search
CPC ..... F04D 1/06; F04D 1/066; F04D 29/4293; F04D 1/10; F04D 29/0473; F04D 29/162; F04D 29/167; F04D 29/185; F04D 29/22
See application file for complete search history.

(56) References Cited

U.S. PATENT DOCUMENTS 2,329,373 A * 9/1943 Hornschuch ..... F04D 1/063 415/100
2,999,465 A * 9/1961 Babb ..... F04D 1/063 415/100
3,612,716 A * 10/1971 Deters ..... F04D 13/10 415/141

(Continued)

FOREIGN PATENT DOCUMENTS

CN 109209898 A * 1/2019 ..... F04D 29/086
JP S58144689 A 8/1983

(Continued)

OTHER PUBLICATIONS

Extended European Search Report issued Apr. 24, 2020 in corresponding European Patent Application No. 19211906.3, filed Nov. 27, 2019.

*Primary Examiner* — Dominick L Plakkoottam
(74) *Attorney, Agent, or Firm* — Spencer Fane, LLP

(57) ABSTRACT

A multistage pump for conveying a fluid includes an outer pump housing, at least first and last stages arranged in the outer pump housing. Each stage includes a stage casing, an impeller, and a diffusor. A pump inlet supplies the fluid to the impeller of the first stage and, a pump outlet discharges the fluid. Each impeller is mounted to a pump shaft in a torque proof manner, and the impellers are arranged one after another on the pump shaft. The last stage includes a collector with a collector chamber to receive the fluid from the diffusor of the last stage. The first stage includes guide channels to receive the fluid from a diffusor and to guide the fluid to the impeller of the next stage. The collector chamber is displaced in the axial direction with respect to the diffusor of the last stage.

12 Claims, 5 Drawing Sheets

(56) References Cited

U.S. PATENT DOCUMENTS

| | | | | | |
|---|---|---|---|---|---|
| 3,779,668 | A * | 12/1973 | Ekey | F04D 1/063 | 416/189 |
| 3,801,217 | A * | 4/1974 | Ryall | F04D 1/063 | 415/214.1 |
| 3,976,395 | A | 8/1976 | Kalnin et al. | | |
| 4,802,819 | A * | 2/1989 | Bevington | F04D 13/10 | 415/199.3 |
| 5,456,577 | A * | 10/1995 | O'Sullivan | F04D 29/086 | 415/199.2 |
| 6,309,174 | B1 * | 10/2001 | Oklejas, Jr. | F04D 29/0416 | 415/58.4 |
| 8,801,360 | B2 * | 8/2014 | Sheth | F01D 1/22 | 415/199.2 |
| 8,985,945 | B2 * | 3/2015 | Nagao | F02C 7/06 | 415/206 |
| 10,161,411 | B1 * | 12/2018 | Gottschalk | F04D 29/22 | |
| 10,364,820 | B1 * | 7/2019 | Oda | F04D 29/624 | |
| 11,821,431 | B2 * | 11/2023 | Ye | F04D 29/043 | |
| 2015/0143822 | A1 * | 5/2015 | Chalmers | F04B 15/08 | 417/424.2 |
| 2015/0330391 | A1 * | 11/2015 | Bergamini | F04D 1/10 | 415/198.1 |
| 2017/0191480 | A1 * | 7/2017 | Lagas | F04D 29/22 | |

FOREIGN PATENT DOCUMENTS

| | | | |
|---|---|---|---|
| JP | 2017096182 | A * | 6/2017 |
| WO | 2014/086730 | A1 | 6/2014 |

* cited by examiner

PRIOR ART

PRIOR ART

MULTISTAGE CENTRIFUGAL PUMP

CROSS-REFERENCE TO RELATED APPLICATION

This application claims priority to European Patent Application No. 19211906.3, filed Nov. 27, 2019, the contents of which are hereby incorporated herein by reference in their entirety.

BACKGROUND

Field of the Invention

The invention relates to a multistage pump for conveying a fluid.

Background Information

Conventional multistage pumps for conveying a fluid can be used in many different industries, in particular for applications where a high pressure is generated. Important industries, in which multistage pumps are used, are for example the oil and gas processing industry, the power generation industry, the chemical industry, the clean and waste water industry or the pulp and paper industry.

In the oil and gas processing industry multistage pumps are designed e.g. for conveying hydrocarbon fluids, for example for extracting the crude oil from the oil field or for transportation of the oil/gas through pipelines or within refineries. Another application is the injection of a process fluid, in most cases water and in particular seawater, into an oil reservoir. For such applications, the pumps are designed as (water) injection pumps supplying seawater at high pressure to a well that leads to a subterranean region of an oil reservoir.

For further applications a multistage pump can be designed as a boiler feed pump for a power plant, or as a booster pump, e.g. in a reverse osmosis process for desalination of water, to mention just a few examples.

A multistage pump can include a plurality of stages each having an impeller, wherein all impellers are arranged on a common pump shaft one after another. The pump shaft is driven for a rotation about an axial direction so that all impellers are commonly rotating about the axial direction.

FIG. 1 is a schematic representation illustrating a multistage pump 1', which is known from the prior art. FIG. 1 shows the multistage pump 1' in an axial cross-section along an axial direction A. For a better understanding FIG. 2 shows the multistage pump 1' in a cross-section perpendicular to the axial direction A as indicated by the cutting line II-II in FIG. 1.

The multistage pump 1' comprises an outer pump housing 2' extending in the axial direction A, which is defined by the axis of a pump shaft 9' centrally passing through the outer pump housing 2'. The outer pump housing 2' comprises a barrel casing 21', which is closed at its first axial end by a suction cover 22' and at its second axial end by a discharge cover 23'. The suction cover 22' and the discharge cover 23' are fixedly mounted to the barrel casing 21'.

The multistage pump 1' comprises a plurality of stages, namely a first stage 31' a last stage 33' and a plurality, here three, intermediate stages 32', wherein all intermediate stages 32' are arranged between the first stage 31' and the last stage 33'. All stages 31' 32', 33' are arranged one after another inside the barrel casing 21', such that the barrel casing 21' encloses all stages 31', 32', 33'.

The multistage pump 1' further comprises a pump inlet 4' for supplying a fluid to the first stage 31' and a pump outlet 5' for discharging the fluid. Thus, the first stage 31' is the stage which is closest to the pump inlet 4' and the last stage 32' is the stage, which is closest to the pump outlet 5'.

Each stage 31', 32', 33' comprises a stage casing 6', an impeller 7' for acting on the fluid and a diffusor 8' configured to surround the impeller 7' and to receive the fluid from the impeller 7'. Each impeller 7' is mounted to the pump shaft 9' in a torque proof manner. All impellers 7' are arranged one after another in the axial direction A. All diffusors 8' of the first stage 31' and of all the intermediate stages 32' comprise guide channels 81' which are arranged downstream of the particular diffusor 8'. The guide channels 81' are configured to receive the fluid from the particular diffusor 8' and to guide the fluid to the impeller 7' of the next stage. The last stage 33' comprises a collector 10' with a collector chamber 11' configured to receive the fluid from the diffusor 8' of the last stage 33' and to guide the fluid to the pump outlet 5'.

The collector 10' is configured to concentrically enclose the diffusor 8' of the last stage 33', such that the collector chamber 11' is designed as an annular collector chamber 11' surrounding the entire diffusor 8' radially outwardly along the circumference of the diffusor 8'. This can be best seen in FIG. 2.

The collection chamber 11' and the diffusor 8' are aligned with respect to the axial direction A, wherein the diffusor 8' is arranged radially inwardly regarding the collection chamber 11' of the collector 10'.

The flow of the fluid through the multistage pump 1' is indicated by the arrows without reference numerals both in FIG. 1 and FIG. 2. The fluid enters the multistage pump 1' through the pump inlet 4', is diverted to the axial direction A and guided to the suction side of the impeller 7' of the first stage 31'. The impeller 7' acts on the fluid and discharges the fluid in radial direction into the diffusor 8' of the first stage 31'. Downstream of the diffusor 8' the fluid is guided by the guide channels 81' of the first stage 31' to the suction side of the impeller 7' of the first intermediate stage 32'. After having passed all intermediate stages 32' in an analogous manner the fluid is guided to the suction side of the impeller 7' of the last stage 33'. The impeller 7' discharges the fluid in radial direction to the diffusor 8' of the last stage 33', from where the fluid enters the collection chamber 11' surrounding the diffusor 8' radially outwardly. From the collection chamber 11' the fluid is discharged through the outlet 5' of the multistage pump 1.

SUMMARY

Starting from this prior art it is an object of the invention to propose a different multistage pump, in particular a multistage pump which can be configured more economically.

The subject matter of the invention satisfying this object is characterized by the features described herein.

Thus, according to the invention, a multistage pump for conveying a fluid is proposed, having an outer pump housing and a plurality of stages arranged in the outer pump housing, the plurality of stages comprising at least a first stage and a last stage, each stage comprising a stage casing, an impeller for acting on the fluid, and a diffusor configured to surround the impeller and to receive the fluid from the impeller, the multistage pump further comprising a pump inlet for supplying the fluid to the impeller of the first stage, a pump outlet for discharging the fluid, and a pump shaft configured for rotating about an axial direction, wherein each impeller is mounted to the pump shaft in a torque proof manner, wherein all impellers are arranged one after another on the pump shaft, wherein the last stage comprises a collector with a collector chamber configured to receive the fluid from the diffusor of the last stage, wherein all other stages than the last stage comprise guide channels configured to receive the fluid from the particular diffusor and to guide the fluid to the impeller of the next stage, and wherein the collector chamber is displaced in the axial direction with respect to the diffusor of the last stage.

The configuration with the collector chamber displaced in the axial direction regarding the diffusor has several advantages. Since it is no longer necessary to arrange the collector chamber of the last stage radially outwardly around the diffusor of the last stage, the outer diameter of the hydraulic part of the multistage pump can be considerable reduced. The outer diameter of the hydraulic part is mainly given by the outer diameter of the fluid guiding components within the multistage pump. Therefore, the inner diameter of the outer pump housing can be considerably reduced.

Thus, even if the wall thickness of the outer pump housing is not reduced the overall outer dimensions, in particular the outer diameter of the multistage pump, are considerably reduced. The reduced overall outer extension of the multistage pump results in a reduced weight of the multistage pump, in a reduced mass of the material that is required for the outer pump housing and in reduced space requirements for the multistage pump. These factors make the multistage pump according to the invention more cost-efficient without any negative influence on the efficiency or the reliability of the multistage pump.

Furthermore, due the reduced diameter the fixing elements for securing the stages, e.g. tie rod, as well as the fixing elements for closing the outer pump housing, e.g. nuts and bolts, can be arranged considerably more inwardly with respect to the radial direction, i.e. closer to the pump shaft. Moving these fixing elements radially inwardly reduces the forces that acts on the fixing elements. Therefore, the fixing elements can be reduced in size.

In addition, a reduced dimension of the outer pump housing, in particular a reduced diameter of the outer pump housing, is favorable in terms of the pressure boundary.

In view of reducing the diameter in particular the diameter of the hydraulic part, it is advantageous that the collector chamber is displaced in axial direction with respect to the diffusor of the last stage to such an amount that the diffusor and the collection chamber do not overlap regarding the axial direction. Thus, the collector chamber is arranged completely behind the diffusor with respect to the axial direction and when viewed in the direction from the pump inlet towards the pump outlet.

Preferably, each impeller is configured as a radial impeller for discharging the fluid in a radial direction with the radial direction being perpendicular to the axial direction. Thus, also the diffusors of the plurality of stages are designed as radial diffusors for receiving the fluid from the particular impeller in a generally radial direction.

According to a preferred embodiment the collector forms the stage casing of the last stage.

Furthermore, it is preferred that the diffusor of the last stage and the collector are configured such that the fluid is diverted in a radial direction within the collector chamber with the radial direction being perpendicular to the axial direction. Accordingly, the diffusor of the last stage guides the fluid into a generally axial flow direction and only within the collector chamber, i.e. downstream of the diffusor the fluid is redirected in a generally radial direction towards the pump outlet.

According to a preferred embodiment, the collector chamber is configured as an annular collector chamber, wherein the outer diameter of the collector chamber is at most as large as the outer diameter of the diffusor of the last stage. By this configuration the outer diameter of the hydraulic part of the multistage pump is particularly reduced.

Advantageously, the outer diameter of the collector chamber equals—at least approximately—the outer diameter of the diffusor of the last stage.

In particular for applications, where a high head or a high pressure at the pump outlet is required the plurality of stages comprises at least one intermediate stage, wherein each intermediate stage is arranged between the first stage and the last stage.

Thus, in particular for high pressure applications it is preferred that the multistage pump is configured with at least three stages, namely a first stage, an intermediate stage and a last stage which are arranged in series with respect to the axial direction. It goes without saying that the multistage pump according to the invention can also be configured with more than three stages.

There are several possibilities for fixing the stages with respect to each other. According to a preferred solution the multistage pump comprises a plurality of tie rods configured for fixing the plurality of stages with respect to each other, wherein each tie rod extends in the axial direction parallel to the pump shaft through all stage casings. In other embodiments there are no tie rods, but the stage casings of the stages are pushed together by the hydraulic forces generated by the multistage pump during operation. In still other embodiments two adjacent stage casings are fixed to each other by fixing elements, e.g. screws or nuts and bolts, only connecting these particular stage casings so that the stage casings are fixed to each other in pairs.

According to a preferred embodiment the outer pump housing comprises a barrel casing, which is configured for receiving all stages, so that the barrel casing encloses the plurality of stages.

Regarding this design the barrel casing is preferably configured with a tubular shape and extending from a first axial end coaxially with the pump shaft to a second axial end.

Furthermore, in this embodiment it is advantageous that the multistage pump comprises a suction cover configured for closing the first axial end of the barrel casing, and a discharge cover for closing the second axial end of the barrel casing.

Preferably, each of the suction cover and the discharge cover is secured to the barrel casing by fixing elements, for example nuts and bolts.

Further advantageous measures and embodiments of the invention will become apparent from the dependent claims.

BRIEF DESCRIPTION OF THE DRAWINGS

The invention will be explained in more detail hereinafter with reference to the drawings.

DETAILED DESCRIPTION

Figure 1:
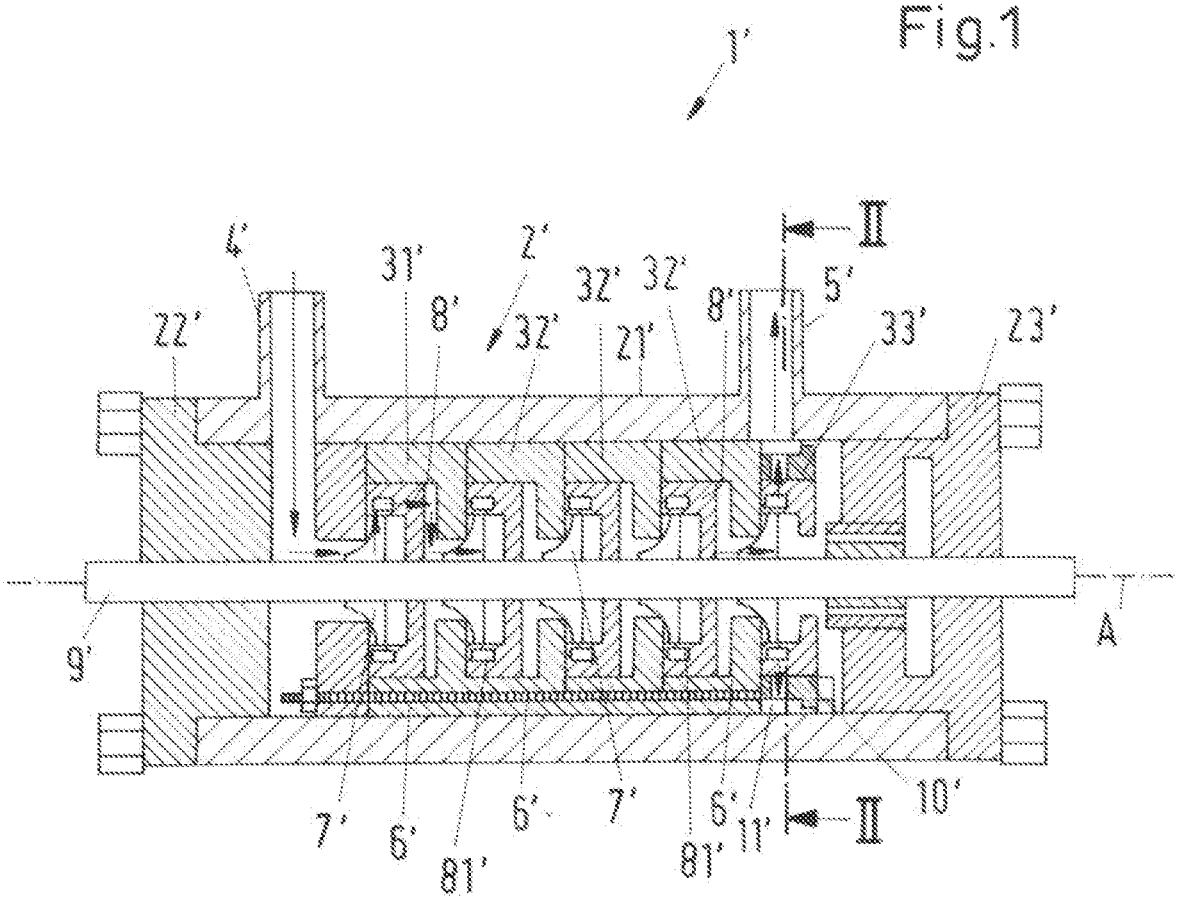
FIG. 1 is a schematic cross-sectional view of a multistage pump known from the prior art in a section along the axial direction.
Figure 2:
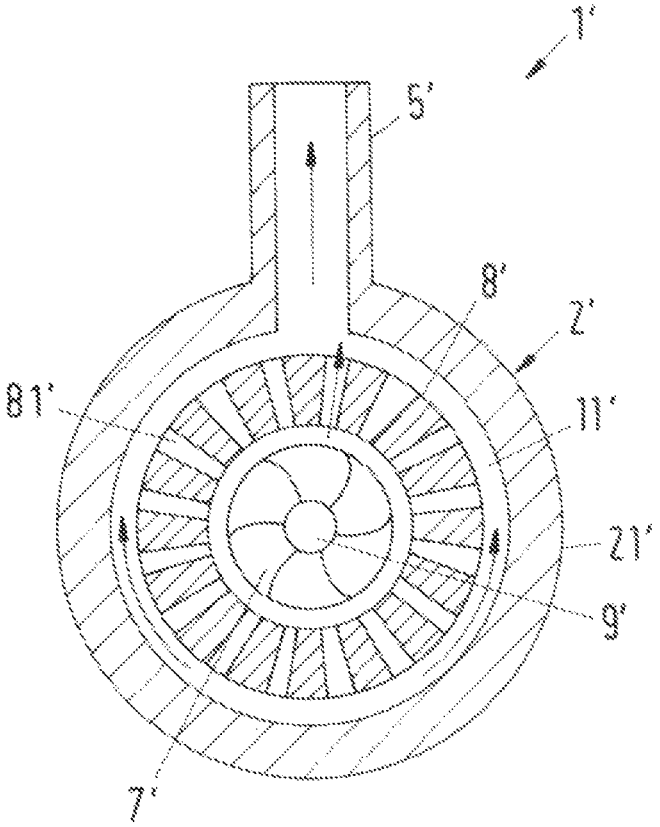
FIG. 2 is the multistage pump of FIG. 1 in a cross-section perpendicular to the axial direction along the cutting line II-II in FIG. 1.

FIG. 1 is a schematic representation illustrating a multistage pump 1', which is known from the prior art. FIG. 1 shows the multistage pump 1' in an axial cross-section along an axial direction A. For a better understanding FIG. 2 shows the multistage pump 1' in a cross-section perpendicular to the axial direction A as indicated by the cutting line II-II in FIG. 1. Since FIG. 1 and FIG. 2 have already been explained hereinbefore in the description of the prior art no further explanations are necessary. In order to differentiate the prior art multistage pump over the embodiments according to the invention, the components of the multistage pump 1' representing prior art are designated in FIG. 1, FIG. 2 and FIG. 6 with reference numerals having a prime (inverted comma) behind the respective reference numeral.

Figure 3:
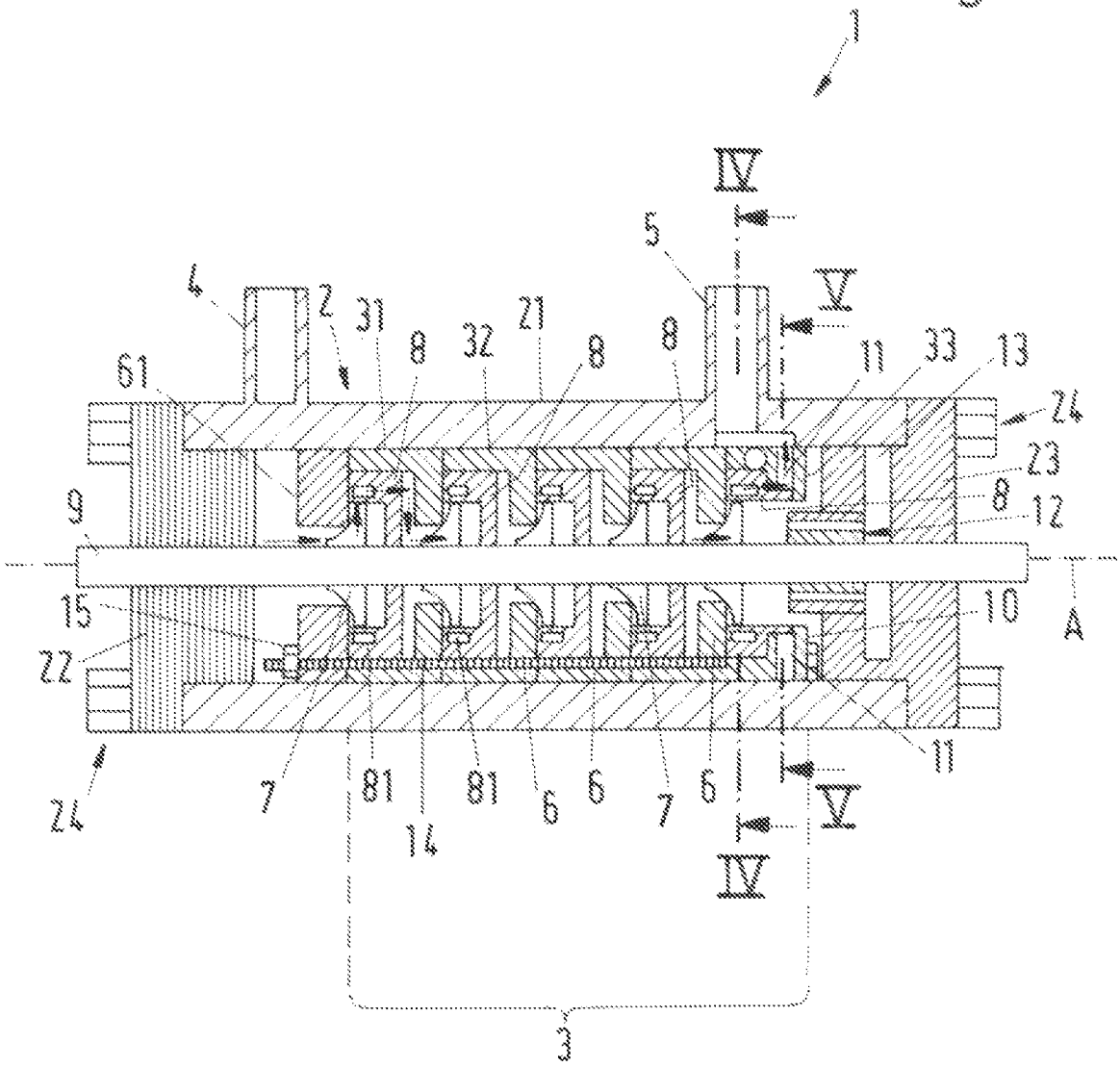
FIG. 3 is a schematic cross-sectional view of an embodiment of a multistage pump according to the invention in a section along the axial direction.

FIG. 3 shows a schematic cross-sectional view of an embodiment of a multistage pump according to the invention, which is designated in its entity with reference numeral 1. The multistage pump 1 is designed as a centrifugal pump for conveying a fluid from a pump inlet 4 to a pump outlet 5.

The multistage pump 1 comprises an outer pump housing 2 and a plurality of stages 3, each of which comprises an impeller 7 for acting on the fluid. All impellers 7 are arranged one after another on a pump shaft 9 configured for rotating about an axial direction A. The pump shaft 9 centrally passes through the outer pump housing 2 and is supported by radial bearings also referred to as journal bearings (not shown) and at least one axial bearing also referred to as thrust bearing (not shown). Furthermore, shaft seals (not shown), for example mechanical seals, are provided in a manner which is known in the art. The shafts seals prevent a leakage of the fluid along the pump shaft 9 from the interior of the outer pump housing 2 to the exterior of the outer pump housing 2.

The axial direction A is defined by the longitudinal axis of the pump shaft 9, i.e. the rotational axis about which the pump shaft 9 rotates during operation. A direction perpendicular to the axial direction A is referred to as 'radial direction'. The term 'axial' or 'axially' is used with the common meaning 'in axial direction' or 'with respect to the axial direction'. In an analogous manner the term 'radial' or 'radially' is used with the common meaning 'in radial direction' or 'with respect to the radial direction'.

All impellers 7 are mounted to the pump shaft 9 in a torque proof manner. The pump shaft 9 is driven by a drive unit (not shown), e.g. an electric motor. In the embodiment shown in FIG. 1 the drive unit is arranged outside the outer pump housing 2 and coupled to the pump shaft 9 in any manner known in the art. In other embodiments the drive unit can be arranged within the outer pump housing 2.

Figure 4:
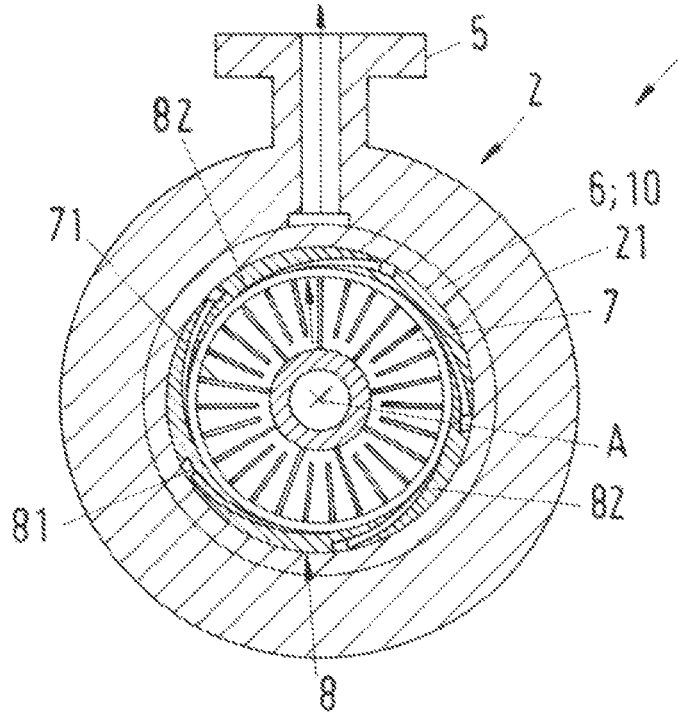
FIG. 4 is the embodiment of FIG. 3 in a cross-section perpendicular to the axial direction along the cutting line IV-IV in FIG. 3.
Figure 5:
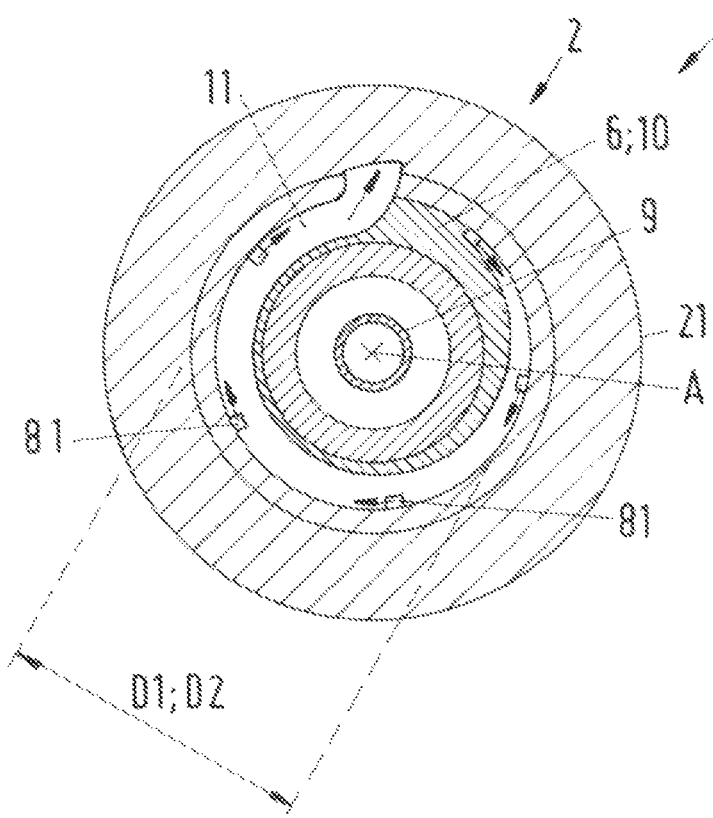
FIG. 5 is the embodiment of FIG. 3 in a cross-section perpendicular to the axial direction along the cutting line V-V in FIG. 3.

FIG. 3 shows the multistage pump 1 in a schematic cross-sectional view in a section along the axial direction A. For a better understanding FIG. 4 shows the multistage pump 1 in a cross-section perpendicular to the axial direction A along the cutting line IV-IV in FIG. 3, and FIG. 5 shows the multistage pump 1 in a cross-section perpendicular to the axial direction A along the cutting line V-V in FIG. 3.

The outer pump housing 2 comprises a barrel casing 21, which is closed at its first axial end by a suction cover 22 and at its second axial end by a discharge cover 23. The suction cover 22 and the discharge cover 23 are fixedly mounted to the barrel casing 21 for example by nuts and bolts 24. The pump shaft 9 passes centrally both through the suction cover 22 and the pressure cover 23. The barrel casing 21 is squeezed between the suction cover 22 and the discharge cover 23. The barrel casing 21 is configured with a tubular shape and extends coaxially with the pump shaft 9 from the first axial end to the second axial end. Furthermore, the barrel casing 21 is designed for receiving the plurality of stages 3, so that the plurality of stages 3 is enclosed by the barrel casing 21.

The multistage pump 1 has the plurality of stages 3, which comprises at least a first stage 31 and a last stage 33. The plurality of stages 3 can further comprise one or more intermediate stage(s) 32. All intermediate stages 32 are arranged between the first stage 31 and the last stage 33 with respect to the axial direction A. All stages 31, 32, 33 are arranged one after another inside the barrel casing 21, such that the barrel casing 21 encloses all stages 31, 32, 33. The first stage 31 is located next to pump inlet 4 near the suction cover 22 and receives the fluid having a low pressure from the pump inlet 4. The last stage 33 is located next to the discharge cover 23 and discharges the fluid having a high pressure through the pump outlet 5. The flow of the fluid through the multistage pump 1 is indicated in the figures by the arrows without reference numeral.

In the embodiment shown in FIG. 3 the multistage pump 1 comprises three intermediate stages 32, therefore the multistage pump 1 has five stages 31, 32, 33. It has to be understood that the number of five stages 31, 32, 33 is only an example. In other embodiments the multistage pump can comprise less than five stages for example only two stages, i.e. there is no intermediate stage. In still other embodiments the multistage pump can comprise more than five stages, for example eight stages.

The multistage pump 1 in FIG. 3 further comprises a balance drum 12, which is arranged between the last stage 33 and the discharge cover 23. The balance drum 12 as such is known in the art. The balance drum 12 has a first axial face exposed to the high pressure behind the last stage 33 and a second axial face, which is exposed to the pressure in the chamber 13, wherein the pressure in the chamber 13 is considerably lower than the high pressure. Usually, the chamber 13 is connected by a balance line (not shown) with the pump inlet 4 so that the pressure in the chamber 13 is essentially the low pressure at the pump inlet 4 on the suction side of the multistage pump 1. A part of the pressurized fluid flows as a leakage flow through an annular gap from the first axial face along the balance drum 12 to the second axial face and into the chamber 13. The pressure difference between the pressure at the first axial face and at the second axial face of the balance drum 12 generates a force on the pump shaft 9 in the axial direction A, wherein the force counteracts the hydraulic force generated by the rotating impellers 7.

Each stage 31, 32, 33 of the plurality of stages 3 comprises a stage casing 6, one impeller 7 for acting on the fluid and a diffusor 8 configured to surround the impeller 7 and to receive the fluid from the impeller 7.

The stage casings 6 are arranged in series with respect to the axial direction A. The stage casing 6 of the first stage 31 abuts against a stationary part 61 of the multistage pump 1, wherein the stationary part 61 is stationary with respect to the outer pump housing 2. Each of the following stage casings 6 abuts against the respective preceding stage casing 6. Thus, the entirety of the stage casings 6 forms an inner pump housing.

The stage casings 6 are fixed with respect to each other by a plurality of tie rods 14. Each tie rod 14 extends in the axial direction A parallel to the pump shaft 9 and through all stage casings 6. The tie rods 14 are tensioned by tensioners 15 in a manner that is known in the art.

All impellers 7 are configured as radial impellers 7 having a plurality of impeller vanes which divert the flow of fluid from a generally axial direction in the radial direction. Each impeller 7 can also comprise back vanes 71 (FIG. 4).

All diffusors 8 are configured as radial diffusors 8 and arranged to enclose the respective impeller 7 radially outwardly. Downstream of each diffusor 8 of the first stage 31 and all intermediate stages 32 a plurality of guide channels 81 is provided in each case to redirect the generally radial flow of the fluid into the axial direction A and to guide the fluid from the respective diffusor 8 to the suction side of the impeller 7 of the next stage.

Preferably, the guide channels 81 are delimited by guide vanes 82 which can be curved to smoothly redirect the fluid. i.e. each guide channels 81 are arranged between two adjacent guide vanes.

The last stage 33 comprises a collector 10 with a collector chamber 11 configured to receive the fluid from the diffusor 8 of the last stage 33 and to guide the fluid to the pump outlet 5.

According to an embodiment of the invention the collector chamber 11 is displaced in the axial direction A with respect to the diffusor 8 of the last stage 33. When viewed in the axial direction A and in a flow direction of the fluid the collector chamber 11 is arranged behind the last stage diffusor 8. Preferably, the collector chamber 11 is displaced with respect to the diffusor 8 of the last stage 33 to such an amount that the diffusor 8 of the last stage 33 and the collection chamber 11 do not overlap regarding the axial direction A.

Arranging the collector chamber 11 behind the diffusor 8 of the last stage 33 has the considerable advantage that the outer diameter of the hydraulic part of the multistage pump 1 is significantly smaller compared to an arrangement where the collector chamber is arranged radially outwardly around the diffusor of the last stage.

In the embodiment of the multistage pump 1 according to the invention, the outer diameter of the hydraulic part is at least essentially the same as the outer diameter D1 of the diffusor 8 of the last stage 33.

Figure 6:
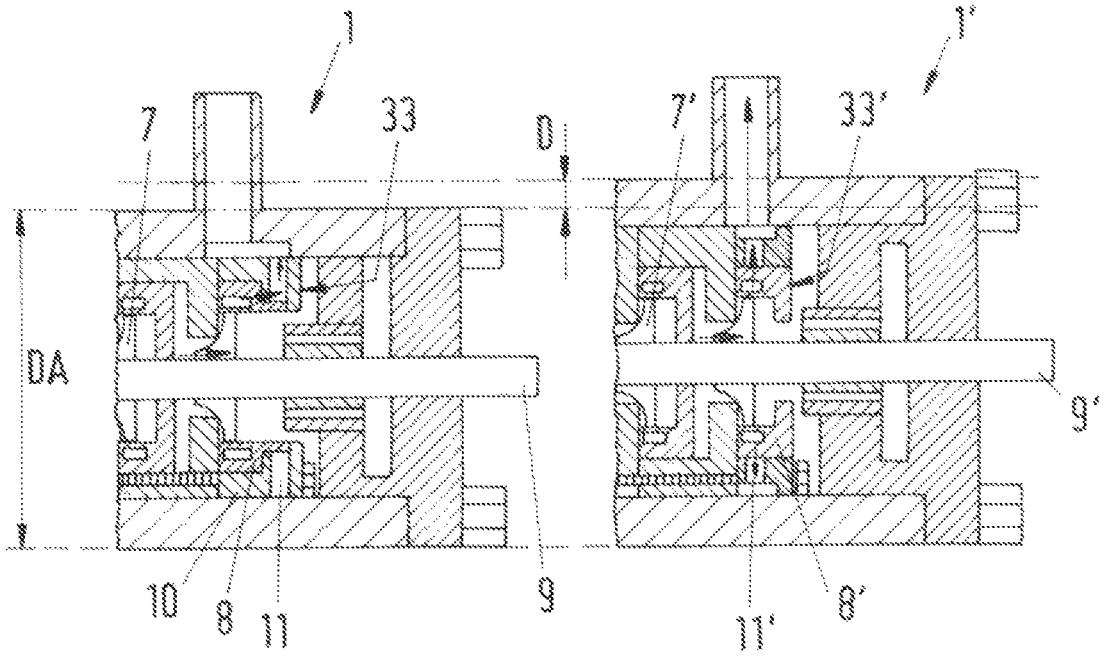
FIG. 6 is a comparison of the last stage of the multistage pump of FIG. 1 (right) with the last stage of the embodiment of FIG. 3 (left).

Since the outer diameter D1 is reduced the inner diameter of the barrel casing 21 can be reduced. Therefore, also the outer diameter DA (FIG. 6) of the barrel casing 21 can be reduced. This reduction D in the outer diameter DA of the barrel casing 21 is illustrated in FIG. 6 by a direct comparison of the embodiment of the multistage pump 1 according to the invention on the left side of FIG. 6 with the prior art multistage pump 1' of FIG. 1 on the right side of FIG. 6. The reduction D can be for example about 20% of the outer diameter of the barrel casing.

Thus, in this embodiment of the invention the overall outer dimensions of the multistage pump, in particular the outer diameter DA of the barrel casing 21, can be considerably reduced. This results in a reduced weight of the multistage pump 1 as well as in a reduction of the mass of material that is required in particular for the barrel casing 21, the suction cover 22 and the discharge cover 23. Therefore, the overall costs for the multistage pump 1 are decreased without scarifying any efficiency or operational safety of the multistage pump 1.

An additional advantage is the fact that the tie rods 14 and the nuts and bolts 24 are closer to the pump shaft 9 with respect to the radial direction. Moving these fixing elements, namely the tie rods 14 for the stage casings 6 and the nuts and bolts 24 for the outer pump housing 2, radially inwardly reduces the forces that act on these fixing elements. Therefore, the tie rods 14 and the nuts and bolts 24 can be reduced in size and/or the number of the tie rods 14 and/or of the nuts and bolts 24 can be reduced.

In addition, a reduced dimension of the outer pump housing, in particular a reduced outer diameter DA of the barrel casing 21, is favorable in terms of the pressure boundary.

The flow of the fluid through the multistage pump 1 is indicated by the arrows without reference numerals in FIGS. 3-6. The fluid enters the multistage pump 1 through the pump inlet 4, is diverted to the axial direction A and guided to the suction side of the impeller 7 of the first stage 31. The impeller 7 acts on the fluid and discharges the fluid in radial direction into the diffusor 8 of the first stage 31. Downstream of the diffusor 8 the fluid is guided by the guide channels 81 of the first stage 31 to the suction side of the impeller 7 of the first intermediate stage 32. After having passed all intermediate stages 32 in an analogous manner, the fluid is guided to the suction side of the impeller 7 of the last stage 33. The impeller 7 discharges the fluid in radial direction to the diffusor 8 of the last stage 33, from where the fluid is guided to the collection chamber 11 arranged behind the diffusor 8 of the last stage 33 with respect to the axial direction A. From the collection chamber 11 the fluid is discharged through the outlet 5 of the multistage pump 1.

As can be seen for example in FIG. 3 it is preferred that the collector 10 forms the stage casing 6 of the last stage 33.

As can be best seen on the left side of FIG. 6, the diffusor 8 of the last stage 33 and the collector 10 are configured such, that the fluid discharged from the impeller 7 in a radial direction is diverted by the diffusor 8 from the radial direction in a generally axial direction A, then from the generally axial direction A in a generally radial direction within the collector chamber 11, and then guided to the pump outlet 5.

Furthermore, it is preferred, as shown for example in FIG. 5 that the collector chamber 11 is configured as an essentially annular collector chamber 11, wherein the outer diameter D2 of the collector chamber is at most as large as the outer diameter D1 of the diffusor 8 of the last stage 33. In particular, the collector chamber 11 can be configured such, that the outer diameter D2 of the collector chamber 11 equals the outer diameter D1 of the diffusor 8 of the last stage 33.

In addition, it is preferred that the collector chamber 11 is shaped as a spiral, such that the collector 10 with the collector chamber 11 is configured as a volute. This configuration of the collector 10 and the collector chamber 11 can be best seen in FIG. 5. The width of the collector chamber 11 in radial direction, i.e. perpendicular to the axial direction A is increasing when viewed in the flow direction of the fluid. Thus, the cross-sectional area perpendicular to the flow direction of the fluid is increasing when viewed in the flow direction of the fluid. The spiral-shaped collector chamber 11 therewith forms a volute with the casing of the collector 10.

The radial impeller 7 of the last stage 33 conveys the fluid in the radial direction into the diffusor 8 of the last stage 33. The diffusor 8 of the last stage 33 is configured to redirect the flow of the fluid from the radial direction in the axial direction A. The fluid leaves the diffusor 8 of the last stage 33 in the axial direction A. The fluid enters the collector 10 in the axial direction A. In the collector 10 the fluid is redirected from the axial direction A into the radial direction. The fluid is guided by the collector chamber 11 of the collector 10 to the pump outlet 5.

What is claimed:

1. A multistage pump for conveying a fluid, comprising:

an outer pump housing;

a plurality of stages arranged in the outer pump housing, the plurality of stages comprising at least a first stage and a last stage, each of the first stage and the last stage comprising a stage casing, an impeller configured to act on the fluid, and a diffusor disposed within the stage casing and configured to surround a radially outermost edge of the impeller and to receive the fluid from the impeller;

a pump inlet configured to supply the fluid to the impeller of the first stage;

a pump outlet configured to discharge the fluid; and a pump shaft configured to rotate about an axial direction, each impeller of the first stage and the last stage mounted to the pump shaft in a torque proof manner, each impeller for the plurality of stages arranged one after another on the pump shaft, the last stage comprises a collector with a collector chamber configured to receive the fluid from the diffusor of the last stage and configured to discharge the fluid radially to the outlet, and the first stage comprises guide channels configured to receive the fluid from the diffusor of the first stage and to guide the fluid to the impeller of a next stage, the collector chamber being displaced in the axial direction with respect to the diffusor of the last stage to such an amount that the diffusor of the last stage and the collector chamber do not overlap in the axial direction, and the diffusor of the last stage configured to redirect the fluid from a radial direction to an axial direction, an outer diameter of the collector chamber being at most as large as an outer diameter of the diffusor of the last stage, and the collector forming the stage casing of the last stage.

2. The multistage pump in accordance with claim 1, wherein each impeller of the first stage and the last stage is a radial impeller configured to discharge the fluid in the radial direction with the radial direction being perpendicular to the axial direction.

3. The multistage pump in accordance with claim 1, wherein the diffusor of the last stage and the collector are configured such that the fluid is diverted in the radial direction within the collector chamber with the radial direction being perpendicular to the axial direction.

4. The multistage pump in accordance with claim 1, wherein the collector chamber is an annular collector chamber.

5. The multistage pump in accordance with claim 4, wherein the outer diameter of the collector chamber is equal to the outer diameter of the diffusor of the last stage.

6. The multistage pump in accordance with claim 1, wherein the plurality of stages comprises at least one intermediate stage, and wherein the at least one intermediate stage is arranged between the first stage and the last stage.

7. The multistage pump in accordance with claim 1, comprising a plurality of tie rods configured to fix the plurality of stages with respect to each other, each tie rod extends in the axial direction parallel to the pump shaft through the plurality of stage casings.

8. The multistage pump in accordance with claim 1, wherein the outer pump housing comprises a barrel casing, in which is configured the plurality of stages, so that the barrel casing encloses the plurality of stages.

9. The multistage pump in accordance with claim 8, wherein the barrel casing has a tubular shape and extends from a first axial end coaxially with the pump shaft to a second axial end.

10. The multistage pump in accordance with claim 9, further comprising a suction cover configured to close the first axial end of the barrel casing, and a discharge cover to close the second axial end of the barrel casing.

11. The multistage pump in accordance with claim 10, wherein each of the suction cover and the discharge cover is secured to the barrel casing by fixing elements.

12. The multistage pump in accordance with claim 1, wherein the collector chamber is configured to receive the fluid from a guide channel of the last stage.

* * * * *